United States Patent [19]

Sparks

[11] 3,936,962

[45] Feb. 10, 1976

[54] BOX CLIP

[76] Inventor: Olin B. Sparks, 8834 Birdwood Road, Houston, Tex. 77036

[22] Filed: Sept. 5, 1974

[21] Appl. No.: 503,233

Related U.S. Application Data

[62] Division of Ser. No. 379,282, July 16, 1973, Pat. No. 379,282.

[52] U.S. Cl. ..... 40/23 A; 40/16.6

[51] Int. Cl.[2] ..... G09F 3/16

[58] Field of Search..... 40/23 R, 23 A, 11 R, 11 A, 40/16.6, 359, 360; 24/261 PC; 281/42 X

[56] References Cited

UNITED STATES PATENTS

| | | | |
|---|---|---|---|
| 1,336,626 | 4/1920 | Hall | 24/261 PC |
| 1,914,671 | 6/1933 | O'Neil | 40/23 A |
| 2,774,124 | 12/1956 | Brady | 40/23 R |
| 3,557,475 | 1/1971 | Verguson | 40/16.6 |

*Primary Examiner*—John H. Wolff

*Attorney, Agent, or Firm*—Michael P. Breston

[57] ABSTRACT

A box clip which comprises a spring clip and a folded shell which is secured to and covers the spring clip. The shell is made from a substantially rectangular, pliable material. A portion of the material extends laterally from the clip and the shell defines vertically-extending walls adapted to slidably receive therebetween a box tray.

2 Claims, 7 Drawing Figures

BOX CLIP

REFERENCE TO RELATED APPLICATION

This application is a division of Applicant's copending application Ser. No. 379,282, filed July 16, 1973, and now Published Pat. Application No. B379,282, published Jan. 28, 1975.

BACKGROUND OF THE INVENTION

Spring-biased, folded clips are known. One such clip is described in U.S. Pat. No. 1,897,755. Another such clip is described in U.S. Pat. No. 1,818,559. The known clips serve the function of removably clipping flat members, typically pages of documents or files.

It is an object of the present invention to provide a new spring-biased, foldable box clip which can serve both as an index clip and as a box clip for storage of articles associated with the clipped member.

SUMMARY OF THE INVENTION

A box clip which comprises a folded shell adapted to slidably receive therein a box tray. The shell is secured to and covers a spring clip. The shell is made from a substantially rectangular, pliable material adapted to be written or printed upon and comprising a portion extending laterally from the clip to facilitate the insertion of a member into the clip.

Figure 1:
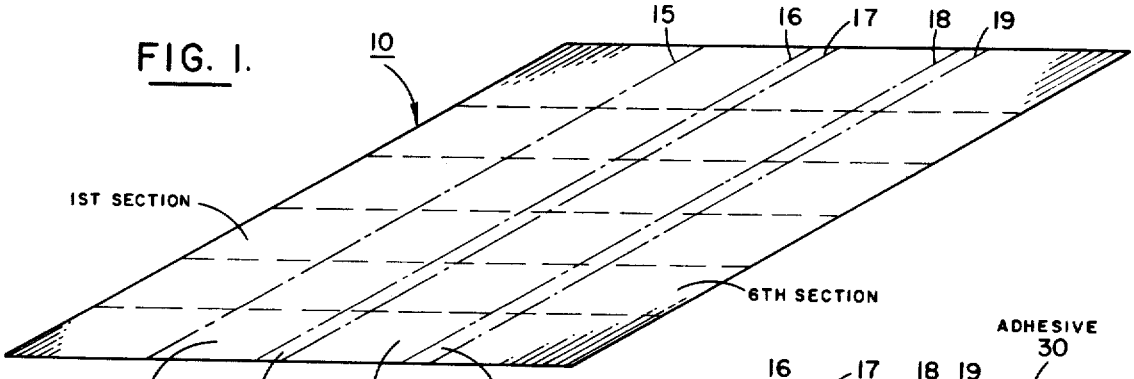
FIG. 1 shows a flat member longitudinally scored to facilitate the folding of the member to the proper dimensions.

Referring to the drawings, wherein the same numerals are used to designate the same parts, there is shown a flat member 10 of a suitable material. Member 10 has a rectangular configuration. While all sides thereof may be equal, it is preferred that its length dimension be slightly longer than its width dimension. The material may be paper, leather, plastic, etc., and preferably is a material which will easily accept printed indicia and writing thereon. Materials of various colors may be used to provide the user an additional variety based on color.

Scores 15–19 divide member 10 into first, second, third, fourth, fifth and sixth sections, respectively. The widths of the combined sections three and four and combined sections five and six are made progressively larger than the width of the second section for reasons which will become subsequently apparent.

Figure 2:
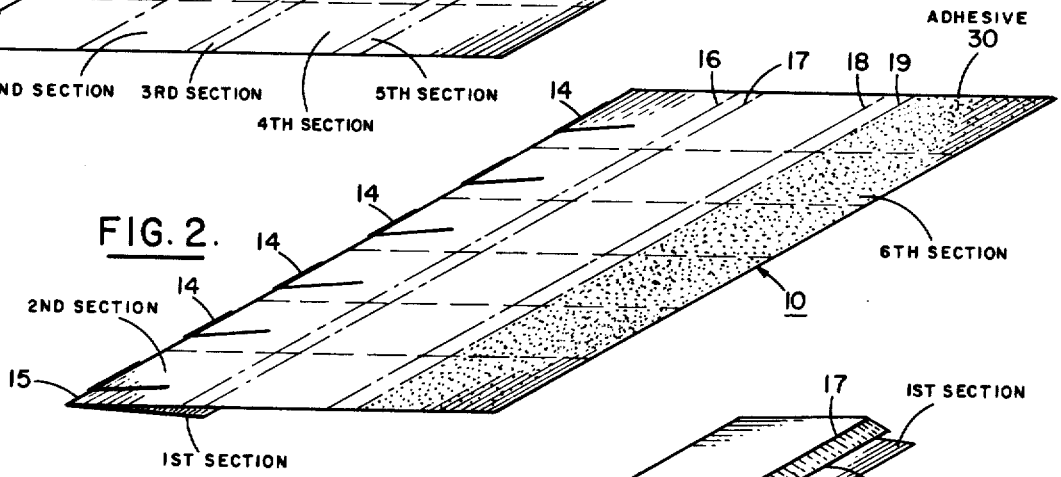
FIG. 2 shows a plurality of spring clips installed on the edge of the first fold and an adhesive applied to a portion of the member.
Figure 3:
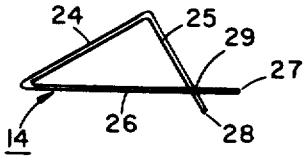
FIG. 3 shows the spring clip of FIG. 2.
Figure 4:
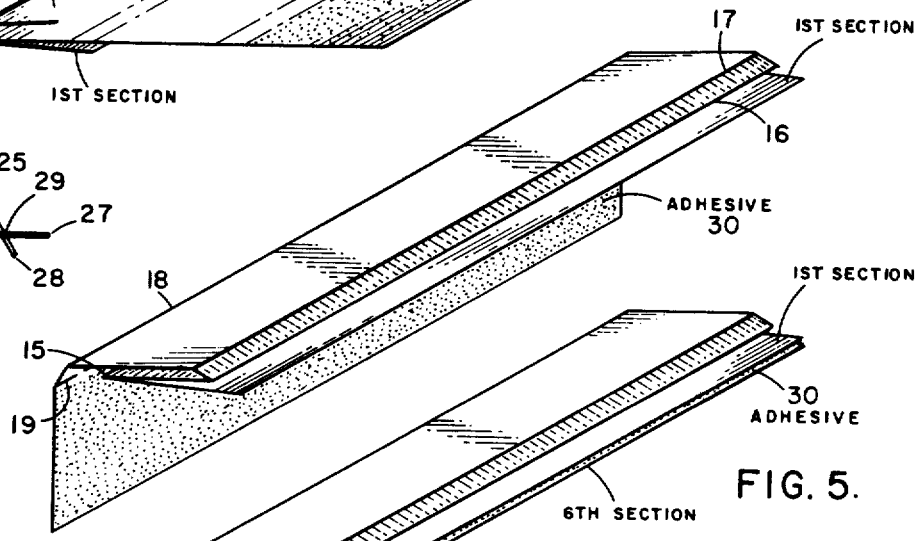
FIG. 4 shows the folded structure in the process of being bent on the remaining scores and prior to the folds being interadhered.

The scored board is then completely folded on score 15 (FIG. 2) to provide a first fold on the edge of which are installed a plurality of metal spring clips 14. While this invention is not limited to any particular type spring 14, in the preferred embodiment it is a wire spring having a triangular configuration with a base 24 and two equal legs 25 and 26 whose free ends 27, 28 extend past their intersection 29. The legs 25, 26 can be sprung apart to insert therebetween and to exert spring pressure on the edge of a flat article desired to be clipped.

Figure 5:
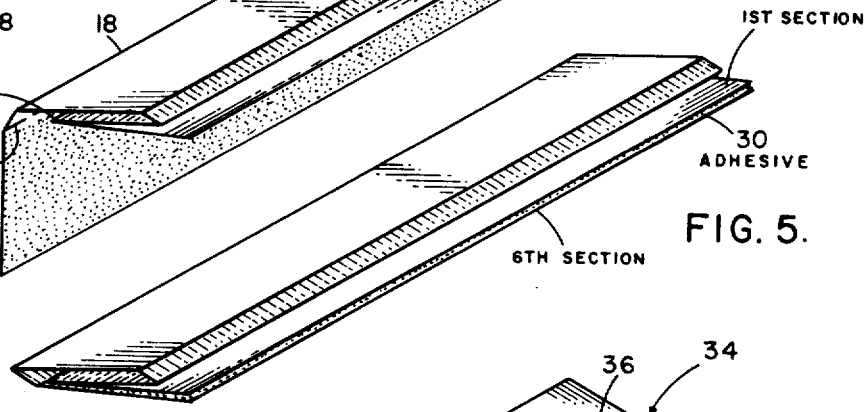
FIG. 5 shows the completely folded, flat structure prior to being cut to finished size.
Figure 7:
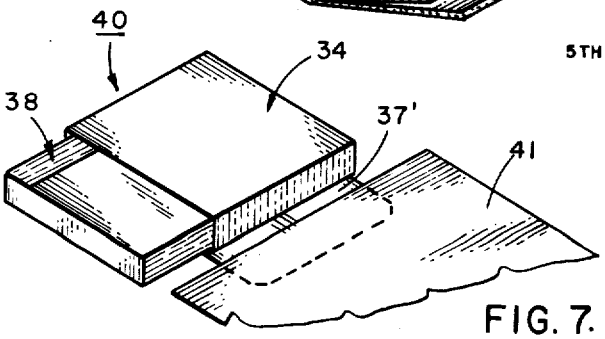
FIG. 7 shows an assembled box clip ready to accept an article to be clipped.
Figure 6:
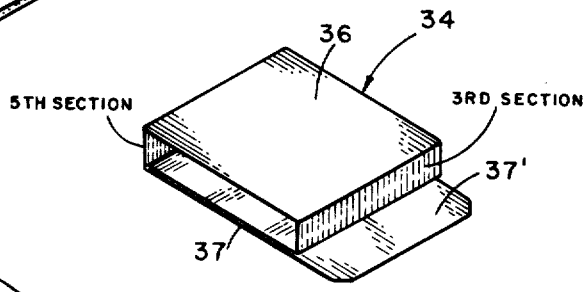
FIG. 6 shows an individual box clip shell resulting from the cutting operation and raised into position to receive a standard slide box tray of appropriate dimensions.

After installing springs 14 on the first fold, a suitable adhesive 30 is applied over the entire surface of the sixth section. Member 10 is then completely bent upon itself, first along score 16 and then along score 18. In the folded structure, score 15 will lie below score 18 and the separation may be according to the depth box desired. The completely folded structure is then pressed tightly for adhesion of all glued folds to each other and to the spring clips (FIG. 5). The folded structure is then cut between the springs to produce individual, flat shells 34 for the box clips (FIG. 6). Each box shell 34 is then ready for assembly with a standard box tray of appropriate dimensions to produce a box clip 40 (FIG. 7). To assemble members 34 and 38, the flat shell 34 is merely raised into a vertical position so that sections three and five become the side walls fo box clip 40.

With the dimensions as previously given, the upper half 36 of each individual box clip 40 will be shorter than the bottom half 37 which defines a laterally-extending portion 37' to facilitate the insertion of a flat, thin article 41 desired to be clipped. The clipped article will cause the legs 25, 26 of the spring clip 14 to separate but they will continue to exert spring pressure against the edge of the article inserted therebetween. The smooth inner folds of the box clip 40 serve to protect the clipped article against mutilation by the metal spring 14. The outer folds can bear printed legends or other decoration, and as previously mentioned may be of a distinct color.

What is claimed is:

1. A tray box clip comprising:

a pliable rectangular shaped shell having a top horizontal wall, a first bottom horizontal wall, and two vertical walls interconnected with said horizontal walls, to form a hollow open-ended shell adapted to receive a tray therewithin, a second bottom horizontal and external wall integral with one of the vertical walls and extending in a plane substantially parallel to said first bottom horizontal wall said second bottom horizontal and external wall consisting of two planar members having securing means therebetween, a wire spring having an open ended curved configuration with one free leg of said spring being sandwiched between said planar members and the other free leg of said spring being elastically urged onto the exposed inner surface of the first bottom horizontal wall, thereby forming an integral and hollow shell with a rectangular cross-section, and a slide tray adapted to be inserted in said shell.

2. The tray box clip of claim 1 wherein said exposed planar member of said second bottom horizontal and external wall extends outwardly of the other of said vertical walls so as to provide a supporting surface for a flat article.

* * * * *